US008648676B2

(12) United States Patent
Abhari et al.

(10) Patent No.: US 8,648,676 B2
(45) Date of Patent: Feb. 11, 2014

(54) TUNABLE SUBSTRATE INTEGRATED WAVEGUIDE COMPONENTS

(75) Inventors: Ramesh Abhari, Montreal (CA); Kasra Payandehjoo, Montreal (CA); Asanee Suntives, Bangkok (TH)

(73) Assignee: The Royal Institution for the Advancement of Learning/McGill University, Montreal, Quebec (CA)

( * ) Notice: Subject to any disclaimer, the term of this patent is extended or adjusted under 35 U.S.C. 154(b) by 334 days.

(21) Appl. No.: 13/102,309

(22) Filed: May 6, 2011

(65) Prior Publication Data

US 2012/0280770 A1 Nov. 8, 2012

(51) Int. Cl.
*H01P 3/16* (2006.01)
*H01P 1/212* (2006.01)
*H01Q 21/00* (2006.01)

(52) U.S. Cl.
USPC ..... 333/250; 333/209; 343/778

(58) Field of Classification Search
USPC ..... 333/208–212, 250, 239; 343/778
See application file for complete search history.

(56) References Cited

U.S. PATENT DOCUMENTS 3,969,729 A * 7/1976 Nemit ..... 343/756
2010/0327990 A1* 12/2010 Yang et al. ..... 333/109
2012/0146741 A1* 6/2012 Yen et al. ..... 333/25

OTHER PUBLICATIONS

He et al., Electrically Tunable Substrate Integrated Waveguide Reflective Cavity Resonator, Microwave Conference (APMC), Dec. 2009.*

Armendariz et al., Tunable SIW Bandpass Filters with PIN Diodes, Microwave Conference (EuMC), Sep. 2010.*

* cited by examiner

*Primary Examiner* — Benny Lee
*Assistant Examiner* — Rakesh Patel
(74) *Attorney, Agent, or Firm* — Morris & Kamlay LLP

(57) ABSTRACT

A method and an apparatus are provided for providing a tunable substrate integrated waveguide (SIW) for which a parameter of at least some element or portion thereof may be altered or varied to alter the propagation of a signal propagating through the SIW thereby achieving a tunable SIW. In some embodiments a plurality of capacitively variably loaded transverse slots achieve the tunability for the SIW.

12 Claims, 20 Drawing Sheets

| Name | Theta | Ang | Mag |
|---|---|---|---|
| m2 | 360.0000 | -0.0000 | 5.4752 |
| m3 | 305.0000 | -55.0000 | 3.2572 |
| m4 | 325.0000 | -35.0000 | 6.1355 |

TUNABLE SUBSTRATE INTEGRATED WAVEGUIDE COMPONENTS

FIELD OF THE INVENTION

The invention relates to integrated waveguides and more particularly to tunable substrate integrated waveguides (SIWs).

BACKGROUND

A SIW is known as an alternative interconnect for high-speed and high-frequency signaling. A SIW offers lower transmission losses and excellent immunity to electromagnetic interference (EMI) and crosstalk in comparison with conventional planar transmission lines. Due to its benefits in the high-frequency regime, many SIW-based components have been introduced for microwave and millimeter-wave applications such as antennas, filters, power dividers and phase shifters.

These microwave components are designed to operate within a certain fixed frequency band in microwave and antenna applications. Unfortunately, in many of the available applications tuning is desirable, for example, to provide an antenna array with beam steering capability. For these applications, phase shifters within the antenna array are controllable to create different beam forming networks and result in different radiation patterns. Thus, in prior art designs SIWs are used for signaling only for fixed frequency applications or a separate tunable element is used to provide tunability.

For fixed applications, SIW technology is usable for providing a fixed phase shift. A simple example is a delay-line phase shifter, which gives a phase shift according to $$\phi(f)=\beta(f)d \tag{1}$$

where $\phi$ is the total phase shift and $\beta$ is the phase constant of a SIW. $\beta$ can be expressed as:

$$\beta(f)=\sqrt{\left(\frac{2\pi\sqrt{\varepsilon_r}\,f}{300}\right)^2-\left(\frac{\pi}{W_{eff}}\right)^2} \tag{2}$$

$W_{eff}$ represents the effective SIW width whose properties are equivalent to that of a rectangular waveguide with solid side walls having $W_{eff}$ width. Since $\beta(f)$ is a strong function of frequency due to the dispersive nature of the waveguide, the phase shift will be varying rapidly over a wide frequency range. This type of phase shift has been implemented. A ferrite-based SIW phase shifter has also been proposed where a ferrite toroid is deposited in an air hole. That said, such a structure has yet to be constructed.

It would be advantageous to provide a SIW that is tunable.

SUMMARY OF THE INVENTION

According to a first aspect, the invention provides for an apparatus comprising: a substrate integrated waveguide (SIW) comprising at least an active element for tuning of the waveguide parameters to achieve a tunable SIW.

According to another aspect, the invention provides for an apparatus comprising: a substrate integrated waveguide (SIW) comprising: a waveguide structure comprising a plurality of transverse slots each spaced one from another by a known distance; and, a plurality of loads for capacitively loading each of the plurality of transverse slots, the plurality of loads providing variable capacitance for altering parameters of the SIW in response to changing of capacitive loading.

According to a further aspect, the invention provides for a method comprising: providing a substrate integrated waveguide (SIW); providing a signal propagating within the substrate integrated waveguide; loading at least a portion of the substrate integrated waveguide to vary a parameter thereof to alter the propagation of the signal propagating within the SIW.

BRIEF DESCRIPTION OF THE DRAWINGS

Exemplary embodiments of the invention will now be described in conjunction with the following drawings, in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
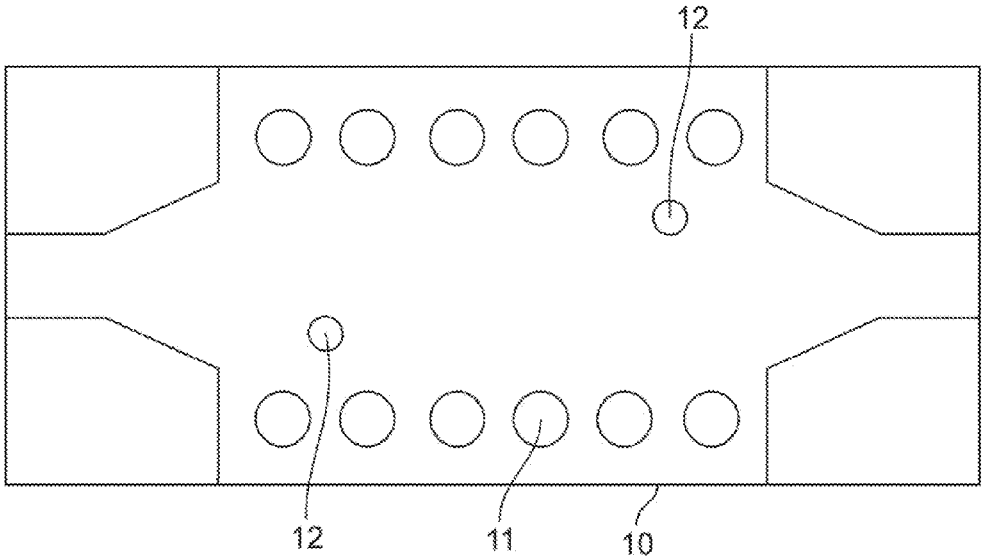
PRIOR ART FIG. 1
FIG. 1 illustrates a top view of a prior art SIW having posts for shifting of phase of a signal propagating therein.

An inductive-post-based phase shifter according to the prior art is shown in FIG. 1 having two posts 12. Siderails 11 of the waveguide are provided within a structure 10. Posts 12 are arranged on the structure 10 offset from the siderails 11. This arrangement gives rise to a phase shift as a function of the position and the diameter of the metal posts. This type of phase shift has an effect on the bandwidths of $S_{11}$ and $S_{21}$ since the structure acts as a filter. For example, in the case of 67.5° phase shift, the insertion loss increases by 5 dB from the minimum within less than 500 MHz. Thus, the design is not broadband and is poorly suited to use over a wide frequency range. The length used in the design was 2.16 $\lambda_g$ (at 9.67 GHz) achieving phase shifts between −14° to 81° depending on the diameter of the posts 12 and an offset from the waveguide side wall 11.

Figure 2:
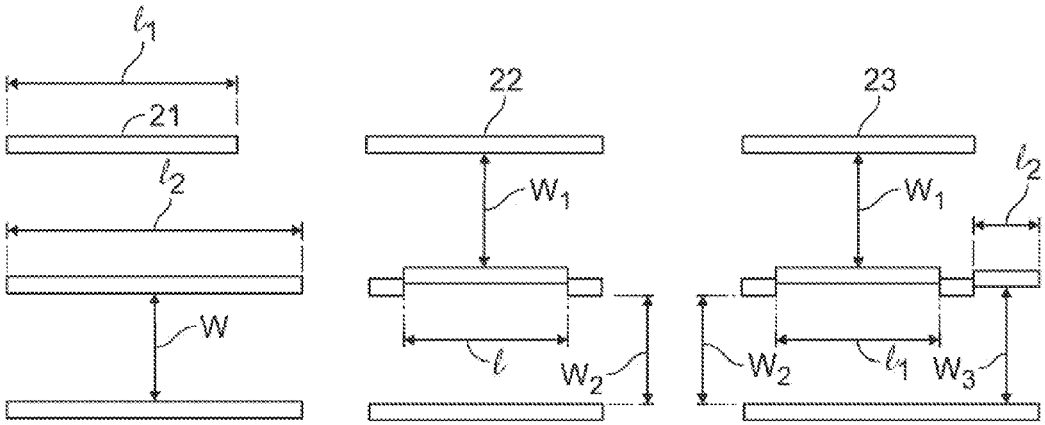
FIG. 2 illustrates in cross-section three different techniques for accomplishing phase shifting.

Another method for shifting phase is to change the width of the waveguide, which effectively alters the phase constant thereof. A similar idea is also proposed with a phase compensating section in order to make the phase shifter broadband. Referring to FIG. 2, a comparison between three techniques—delay line 21, equal-length unequal-width 22 and compensating phaser 23 was performed in terms of bandwidth. The compensating phaser shows a very broadband performance. The measured data demonstrates a phase shift of 90°±2.5° between 25.11 and 39.75 GHz (49% bandwidth). For 90° phase shift at 30 GHz, Type 1 delay line 21 has a length of 0.25 $\lambda_g$ whereas Type 2 22 and Type 3 23 have 1.45 $\lambda_g$ and 1.31 $\lambda_g$, respectively. That said, each of the phase shifters functions to shift a phase of a signal propagating therein.

Figure 3:
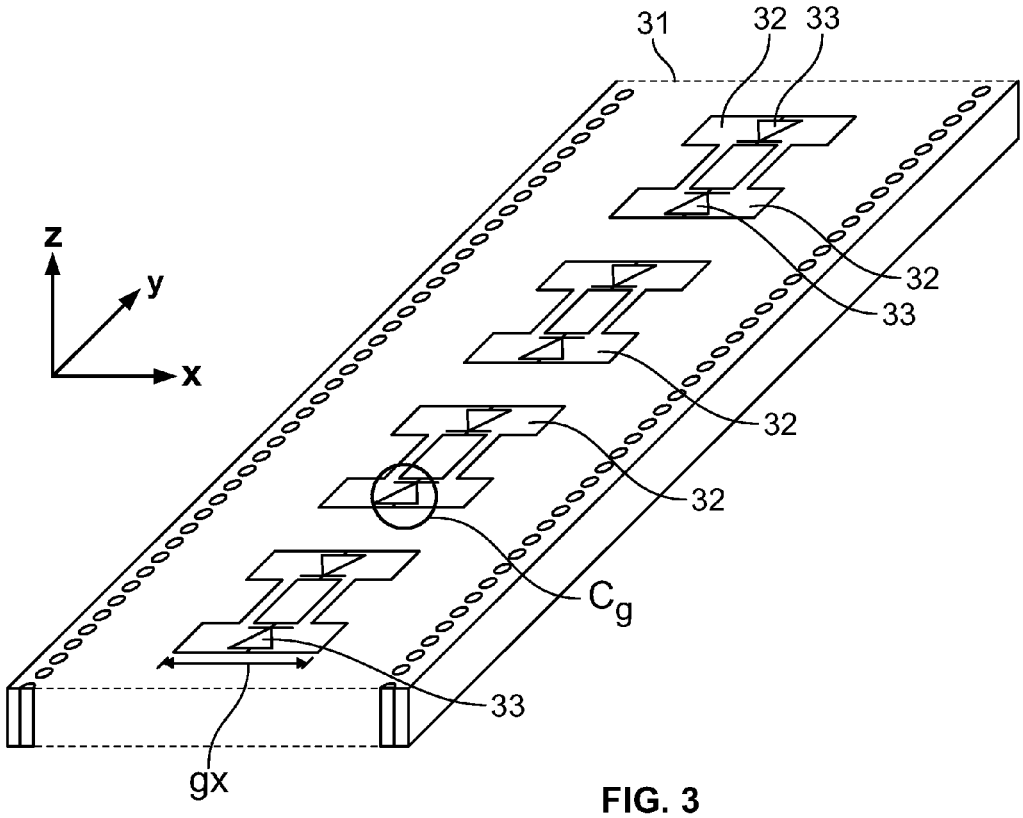
FIG. 3 is an perspective view of a tunable SIW according to an embodiment of the invention.

Referring to FIG. 3, a SIW phase shifter according to an embodiment of the invention is shown wherein a waveguide 31 is periodically loaded with transverse slots 32. Varactor diodes 33 whose capacitance values are equivalent to $C_g$ are loaded across the slots 32 in the longitudinal direction. The capacitances of the varactor diodes are alterable by altering a DC supply voltage (NOT SHOWN). Therefore, a delay or phase shift along the waveguide 31 is electronically controllable. Since the surface current on a top conductor of the waveguide 31 is largely concentrated at a center thereof and propagates in a longitudinal direction (shown as y), loading of the waveguide 31 with varactor diodes 33 effectively changes the propagation delay.

Gap width ($g_x$) is selected to be small to limit radiation from the slots. Typically, a slot is much smaller than the effective wavelength whose effective dielectric constant is found from $\in_{eff}=(\in_r+1)/2$.

Figure 4:
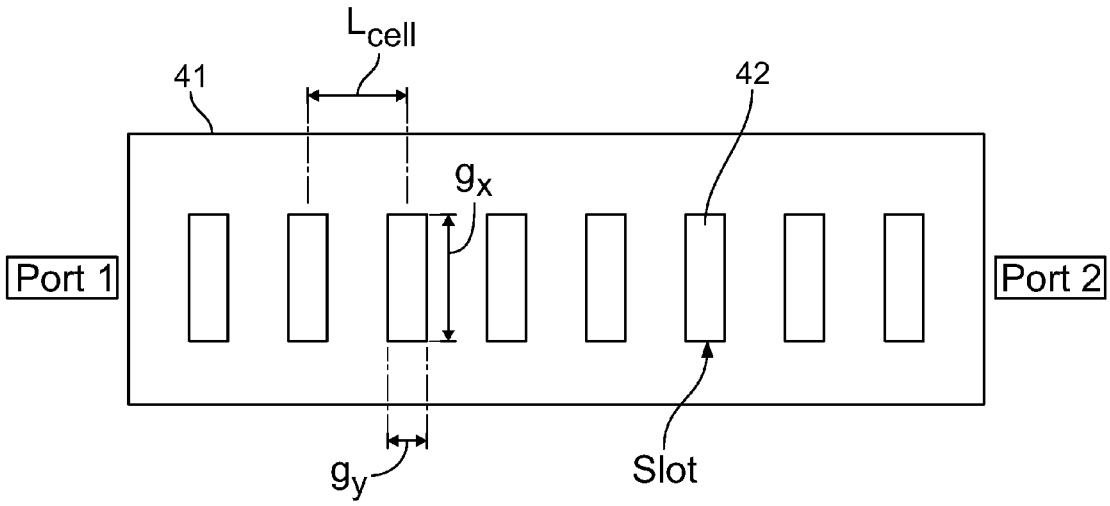
FIG. 4 is a simplified top view of a SIW comprising slots.

Referring to FIG. 4, slots 42 represent where diodes (NOT SHOWN) or capacitors would be placed for utilizing the structure 41 as a phase shifter. An implementation is discussed hereinbelow as an example and is not intended to limit the present embodiment or the invention to a specific operating range or to specific dimensions as set forth. That said, it is beneficial to discuss an actual device.

When the waveguide is designed to operate within the Ku-band (12-18 GHz) with specifications and parameters of the following:

Rogers RO4350 substrate: $\in_r=3.66$ and tan $\delta=0.004$

Effective waveguide width=7.8 mm ($TE_{10}$ cutoff=10.05 GHz)

At 15 GHz, $\lambda=10.45$ mm, $\lambda_g=14.08$ mm and the length of the slot ($g_y$) is fixed at 0.6 mm. Its width ($g_x$) is varied between 0.9 and 2.5 mm. There are 8 slots, which are placed 1.5 mm apart ($L_{cell}$). The substrate and conductor are considered lossless. Therefore, the total radiated power, can be estimated from (3).

$$P_{radiated}=1-|S_{11}|^2-|S_{21}|^2 \quad (3)$$

Figure 5A:
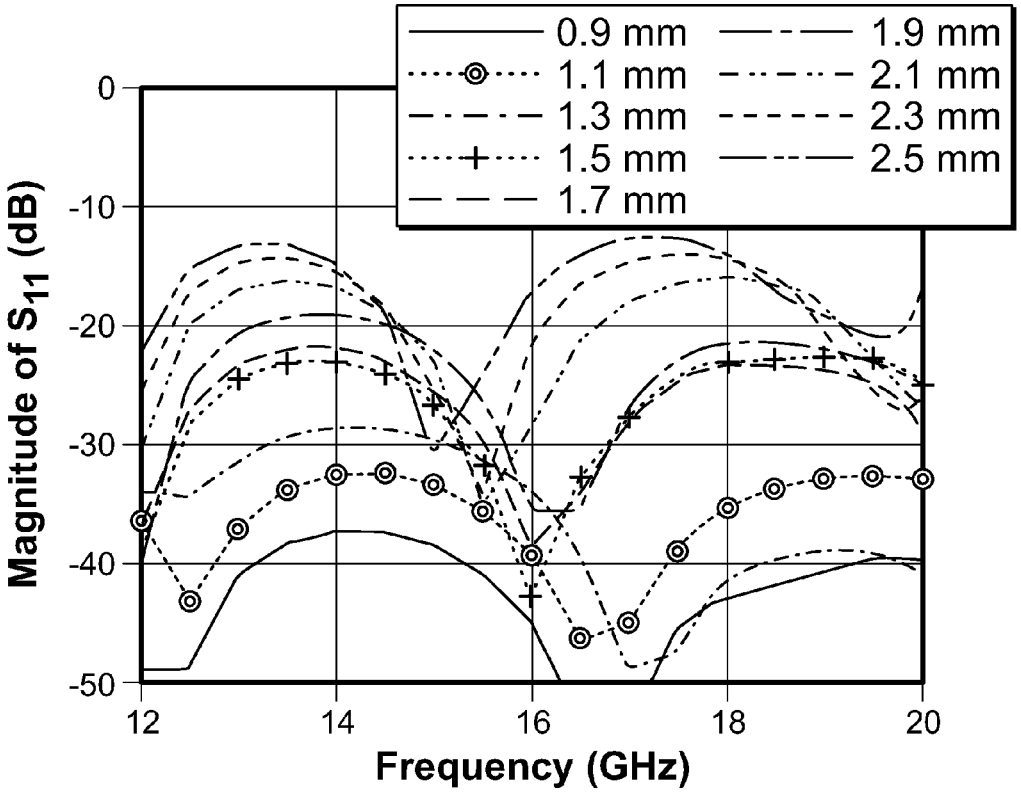
FIGS. 5*a*, 5*b* and 6 are simulation results for the SIW of FIG. 4 having slots of different widths along the transverse dimension.
Figure 5B:
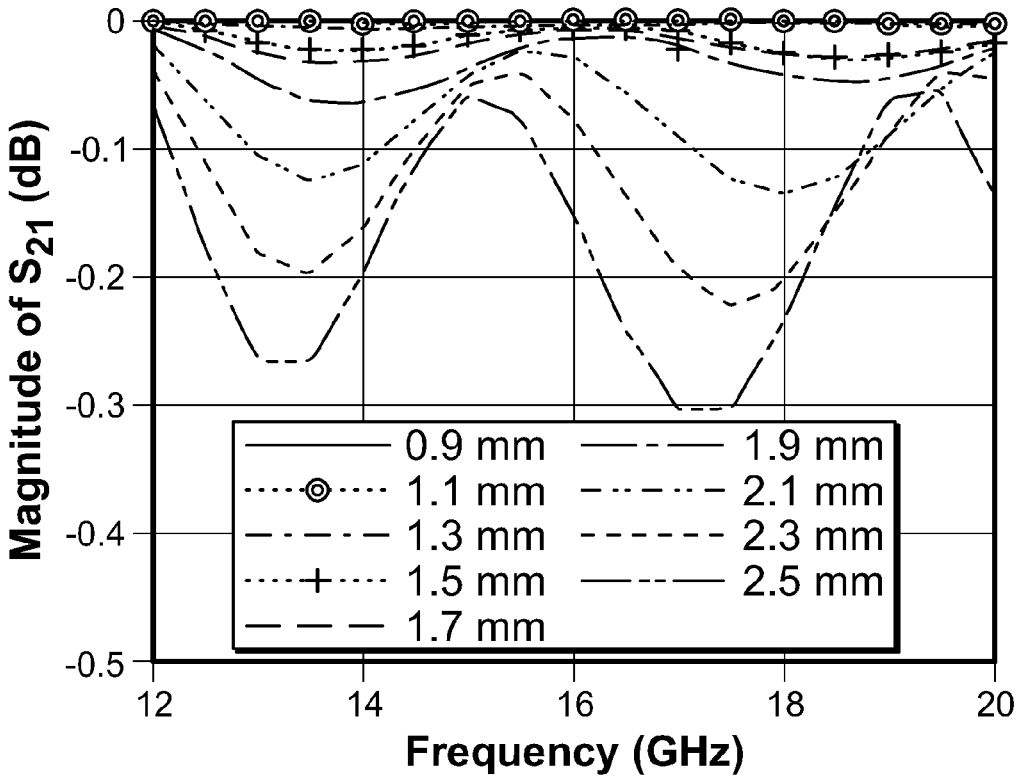
Figure 6:
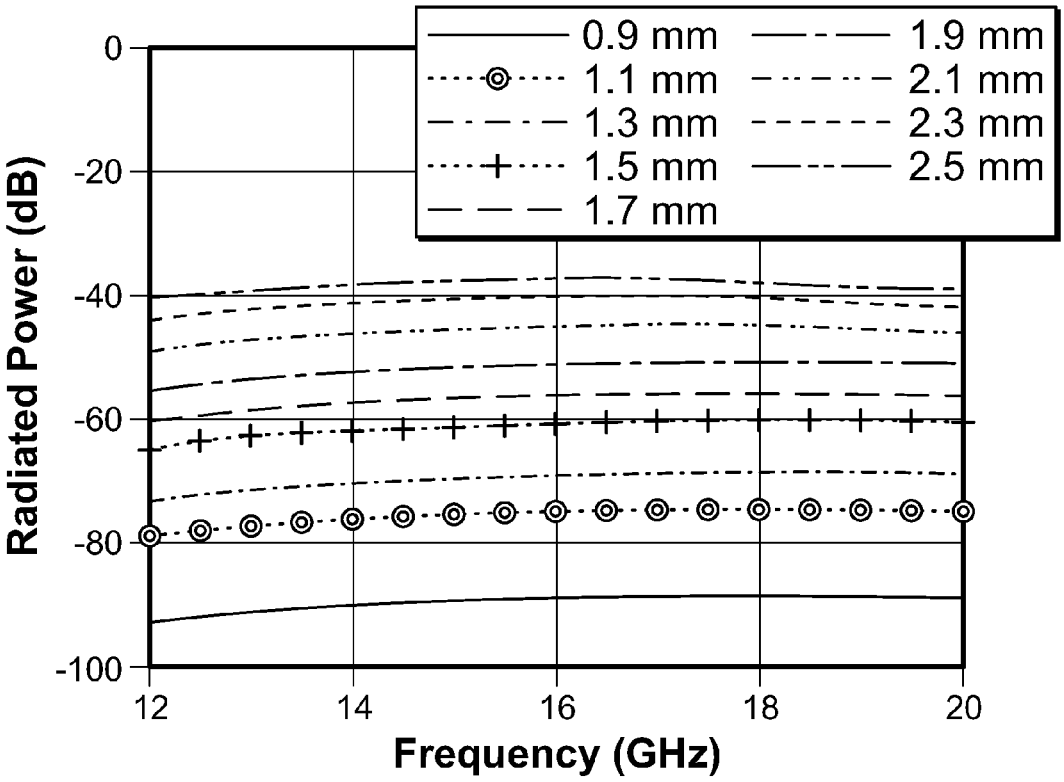

The simulated $S_{11}$ and $S_{21}$, of the structure under study are presented in FIG. 5. As $g_x$ changes from 0.9 to 2.5 mm, the magnitude of $S_{21}$ decreases slightly to at most 0.3 dB. However, noticeable deterioration in the input return loss is observed with a worst level of return loss still higher than 12 dB. FIG. 6 shows the estimated radiation loss, which is generally well below −40 dB. Radiation loss increases when the slot width increases. For the widest slot of 2.5 mm, the radiation loss, which is below −37 dB, is still considered insignificant for many applications. Thus these slot sizes are acceptable for design of SIW phase shifters for the present example. Of course, given a specific band of frequencies, a similar experiment is performable to determine appropriate slot sizes for design of other SIW phase shifters.

Figure 7:
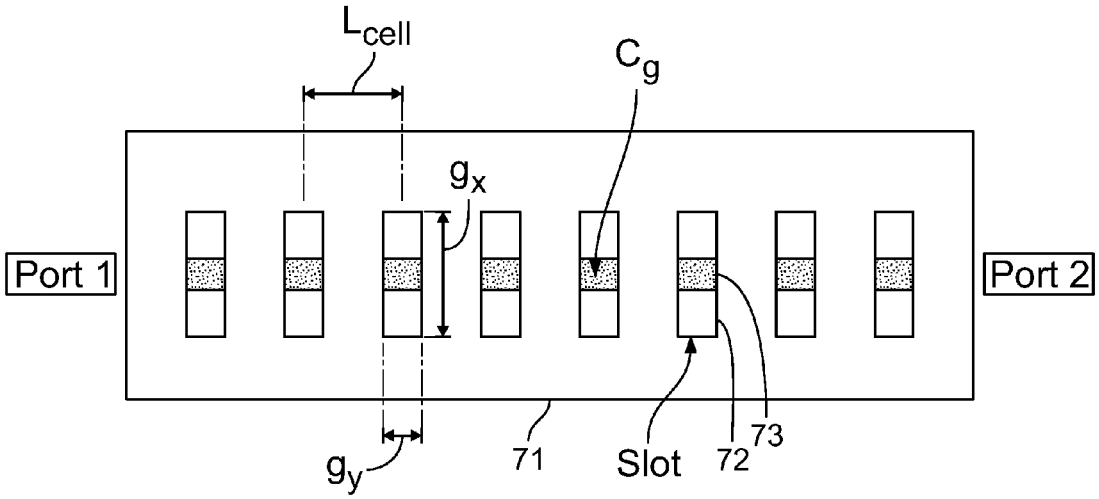
FIG. 7 is a simplified top view of a SIW comprising capacitively loaded slots.

A SIW 71 according to the present embodiment is shown in FIG. 7. Capacitors 73 are disposed across slots 72. These capacitors 73 are, for example, implementable using varactor diodes to support tunability. The capacitors 73 act to load the slots and thereby provide for shifting of phase of a signal propagating within the SIW relative to a same structure with unloaded slots.

Figure 8:
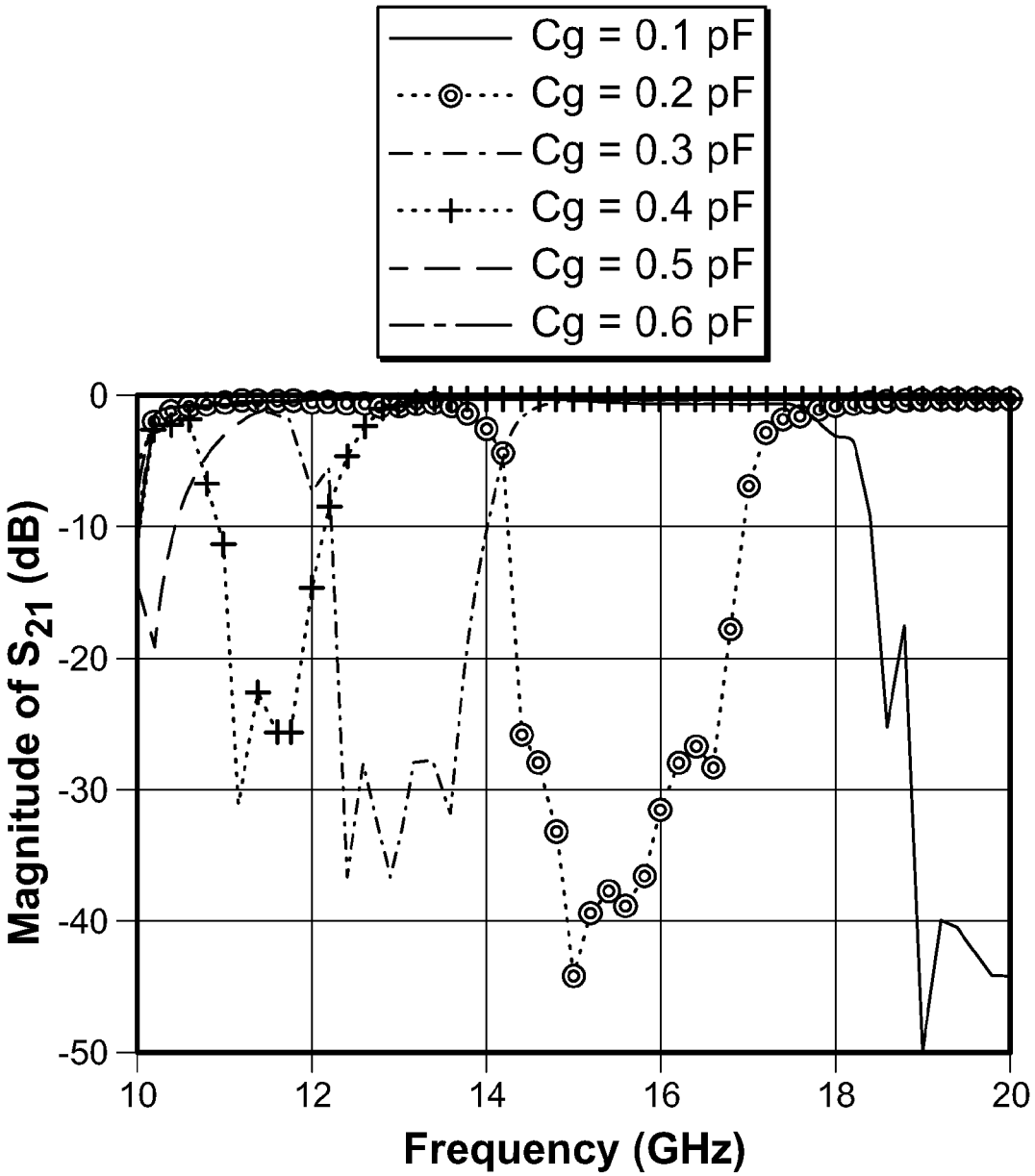
FIGS. 8-11 are simulation results for the SIW of FIG. 7 with varying capacitance and different slot width.
Figure 9:
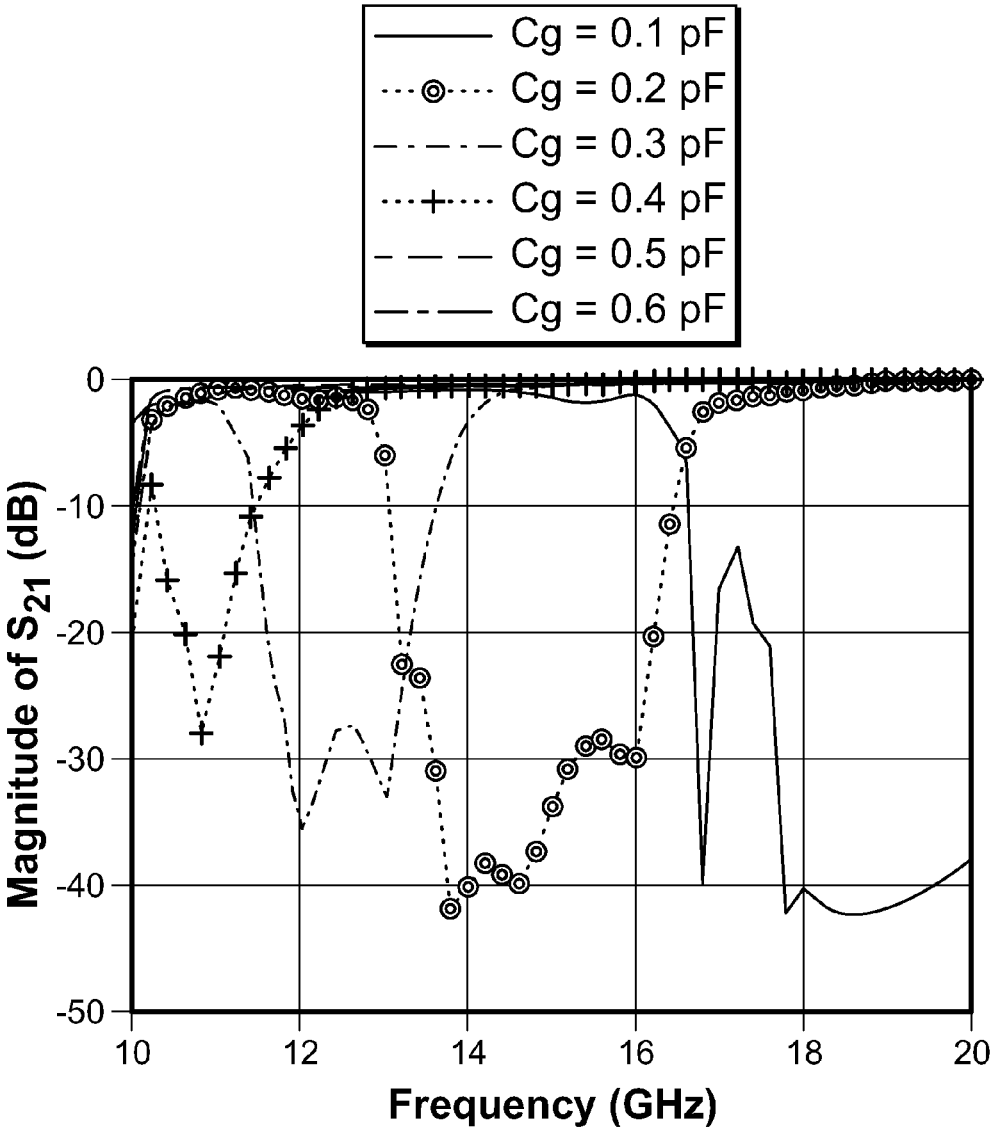

The effect of the slot size, i.e., $g_x$=0.9, 2.0, 2.5 mm, and more particularly respective insertion losses are presented in FIGS. 8 and 9 for different $C_g$ (0.1-0.6 pF). FIG. 8 shows a narrow stopband in $S_{21}$ for each $C_g$ when $g_x$=0.9 mm. The resonance frequency decreases as the value of $C_g$ increases. When $g_x$ increases to 2 mm, the resonant frequencies have significantly shifted to the lower frequency region as shown in FIG. 8. At the same time, the width of the stopband has widened. A similar observation can also be seen when $g_x$ increases from 2 to 2.5 mm as shown in FIG. 9.

Figure 10:
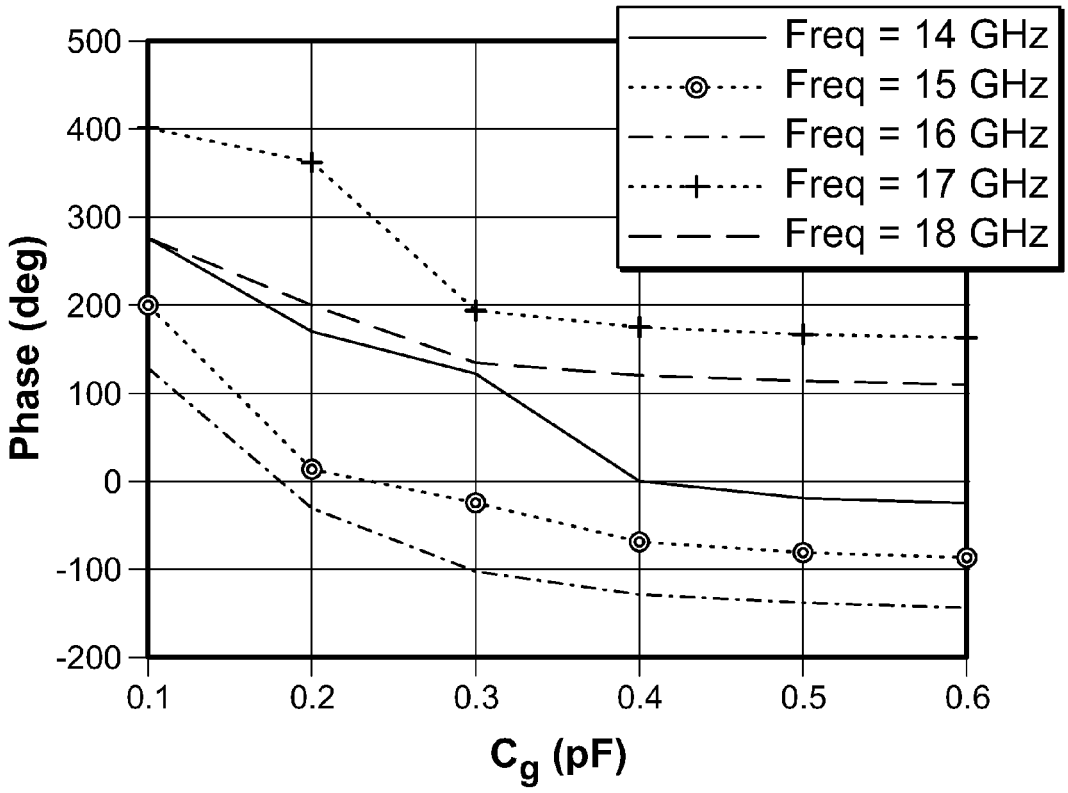
Figure 11:
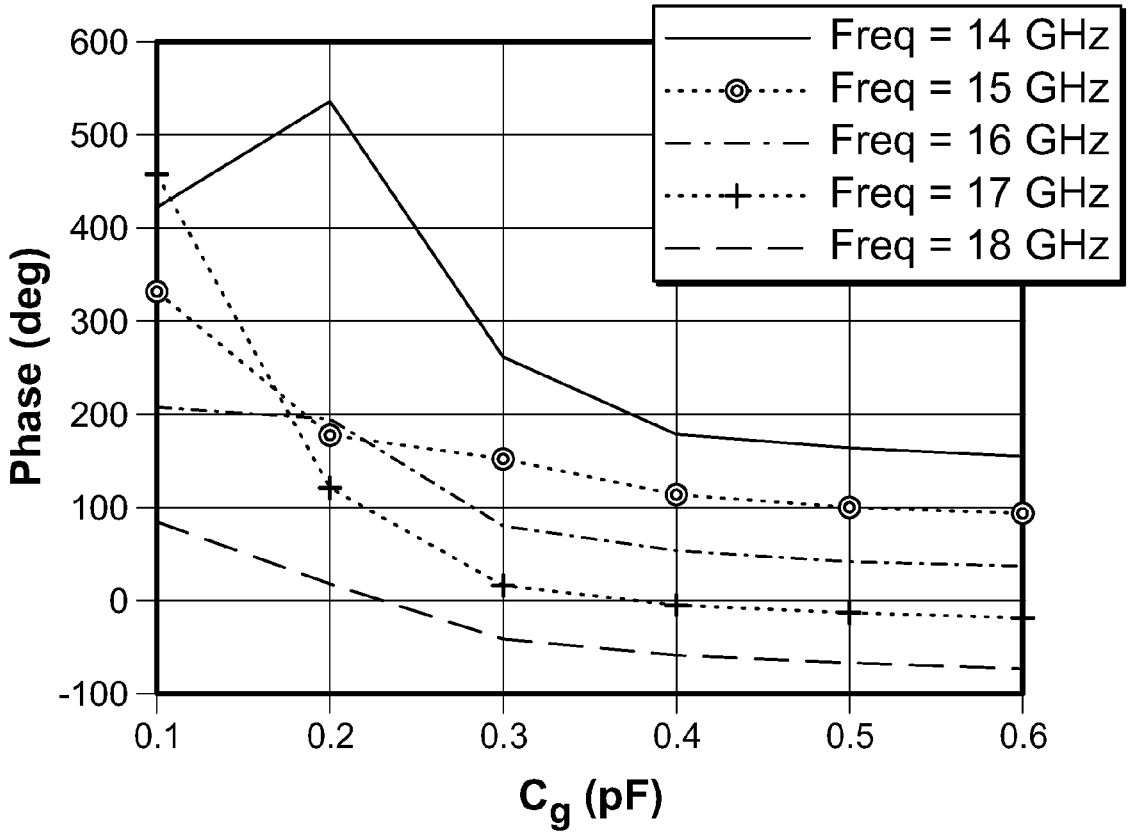

Next, phase shifts as a function of $C_g$ for two slot sizes, namely 2.0 mm and 2.5 mm, are presented respectively in FIGS. 10 and 11 (only at 14, 15, 16, 17 and 18 GHz). It is first observed that for a slot width of 0.9 mm (not shown in the Figures), a relatively wide range of $C_g$ is required to change the phase shift within 360°. When the slot width increases to 2 and 2.5 mm, it appears that the range of phase shift decreases. Furthermore, only a small range of $C_g$ gives a significant change in the phase shift. Optionally slot size is optimized such that resonances are avoided within operating frequency band. It is therefore evident that a capacitively loaded slot disposed within a SIW is a functionally useful component.

Considering that $\lambda_{eff}$=14 mm, a gap width, $g_x$, of 2 mm is large enough to ensure that the slot is not radiating substantially. Using this value for gap width, according to FIG. 12, multi-unit cell varactor-loaded waveguide phase shifters provide a good range of phase shift versus capacitance. Each unit-cell 129 comprises a slot 122 and a varactor 123 disposed for tunably loading of the slot 122. 7 unit cell waveguide phase shifters were used between consecutive elements 128 of a 4-element slot array with transverse slot radiators (slots along x) as shown. The displacement between slots 128 correspond to $\lambda_{freespace}/2$. FIG. 13 shows a radiation pattern of the array of FIG. 12 in the y-z cut plane for different values of capacitance. A beam steering range of 30° was achieved.

Figure 14:
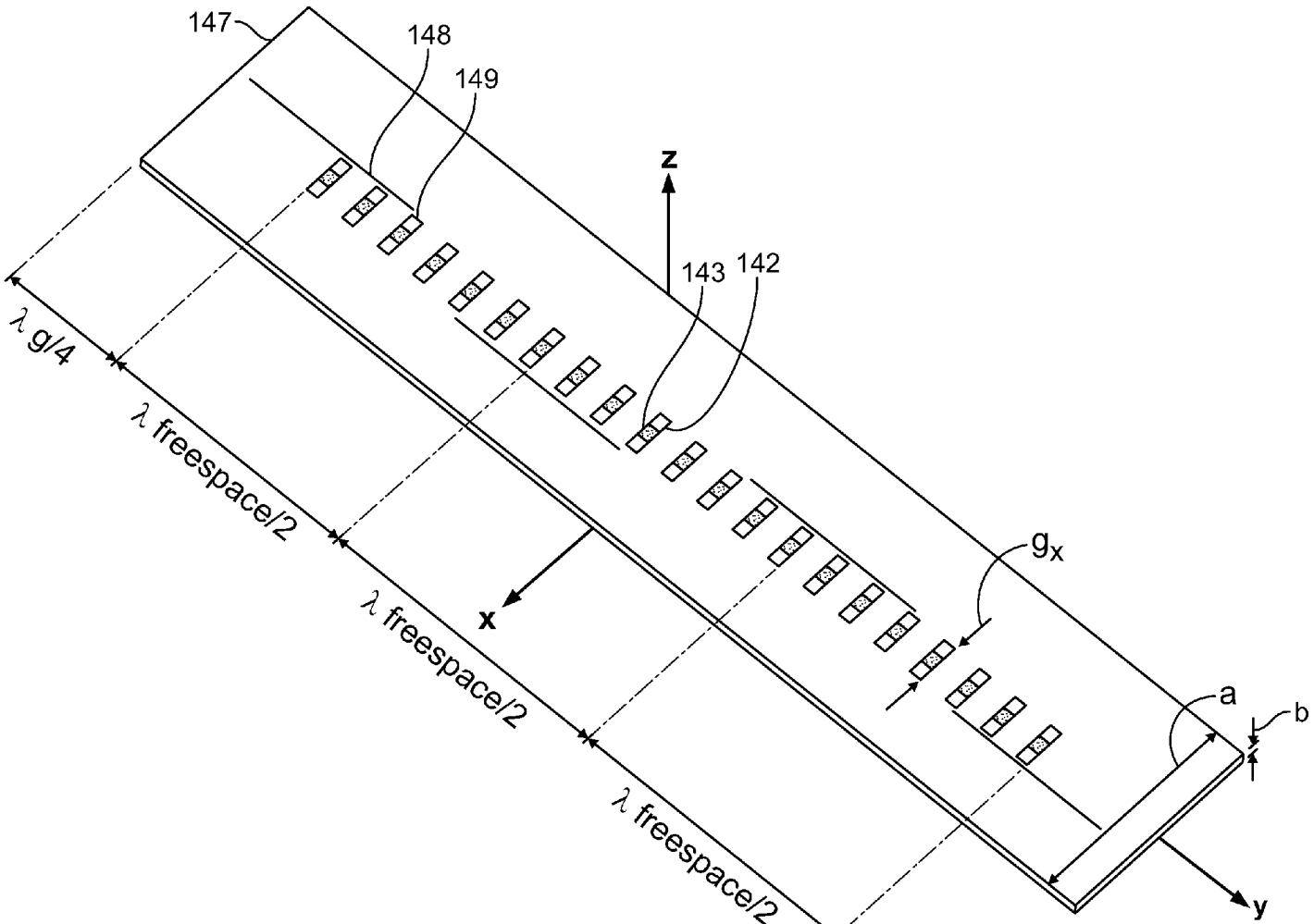
FIG. 14 is a perspective view of phased array having 4 longitudinal radiators and formed within a SIW.

Referring to FIG. 14 and considering that $\lambda_{eff}$=14 mm, a gap width of 1.6 mm is large enough to ensure that the slot is not radiating substantially, a slot radiator have longitudinal slots for radiating is shown. Using this value for gap width, a multi-unit cell varactor-loaded waveguide phase shifter provides a good range of phase shift versus capacitance. Slots 142 are each loaded with at least a varactor 143 to form a unit cell 149. 7 unit cell 149 waveguide phase shifters were disposed adjacent elements of a 4-element slot array with longitudinal slot radiators 148 (slots along y) as shown in FIG. 14. The displacement between radiating slots 148 correspond to $\lambda_{freespace}/2$.

Figure 15:
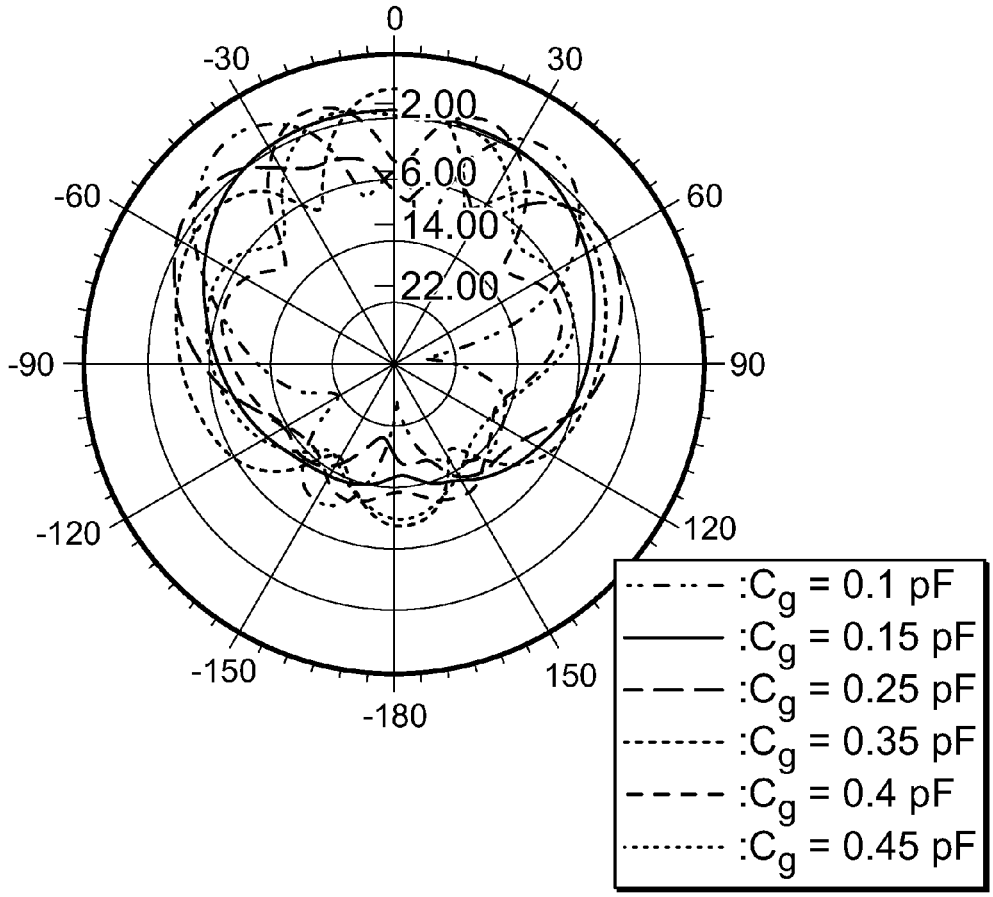
FIG. 15 is a simulation result for the radiation pattern of the device of FIG. 14.

The structure in FIG. 14 is terminated at one end to a solid wall 147 in the form of a short. To ensure that the E-field at the location of the wall 147 is a maximum, the spacing of the center of an adjacent slot from the solid wall is chosen to be equal to $\lambda_g/4$. Optionally another spacing is used having a similar result. FIG. 15 shows the radiation pattern of the array in the y-z cut plane for different values of the capacitance. A beam steering range of 50° was achieved.

Figure 16:
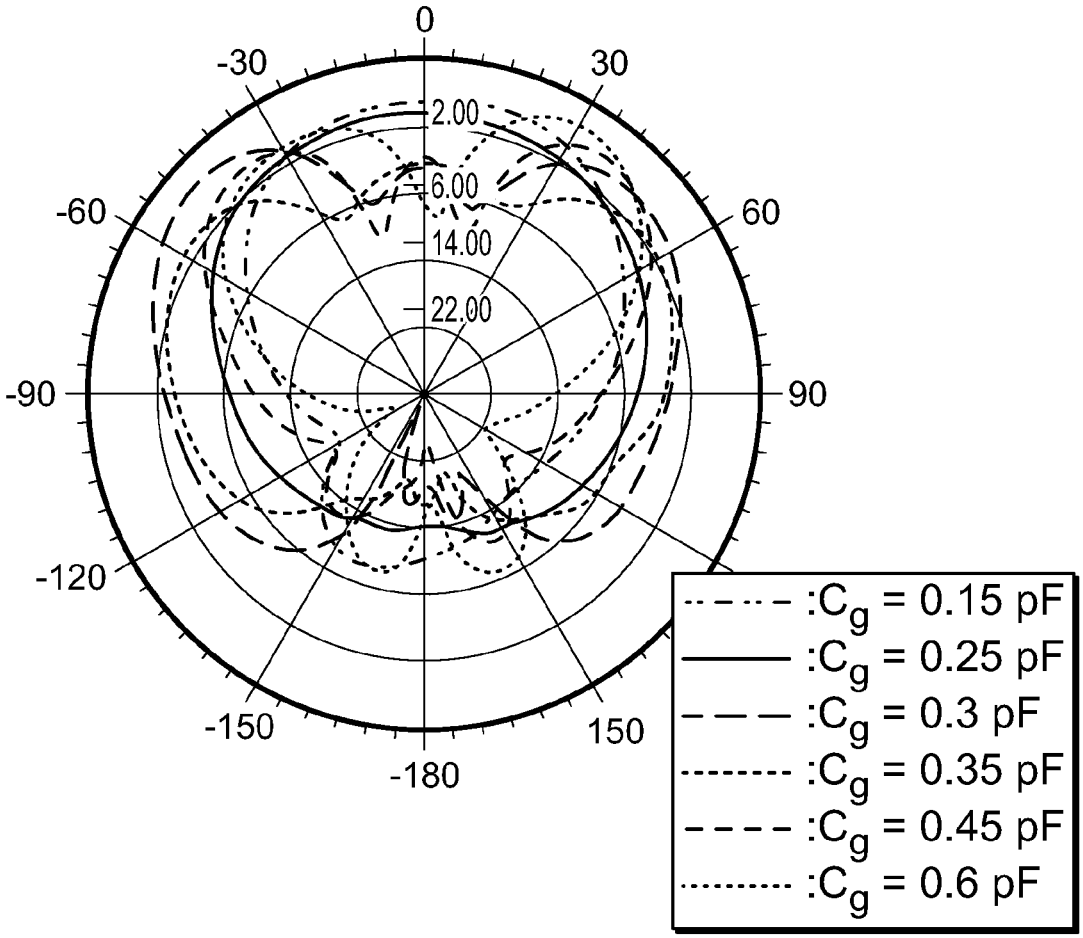
FIG. 16 is a simulation result for the radiation pattern of the device similar to that of FIG. 14 but having more radiators.

Next, the spacing between the radiating slots 148 in FIG. 14 was reduced by half allowing accommodation of 7 radiating slots (rather than 4) within the same longitudinal array length. FIG. 16 shows the radiation pattern of the 7-element array in the y-z cut plane for different values of the capacitance. A beam steering range of 60° was achieved.

For specific implementations, further optimization is suggested to ensure that the longitudinal slots radiate most of the input power. Optionally, this involves adjusting slot offsets, $x_{offset}$, from the center of the waveguide.

Figure 12:
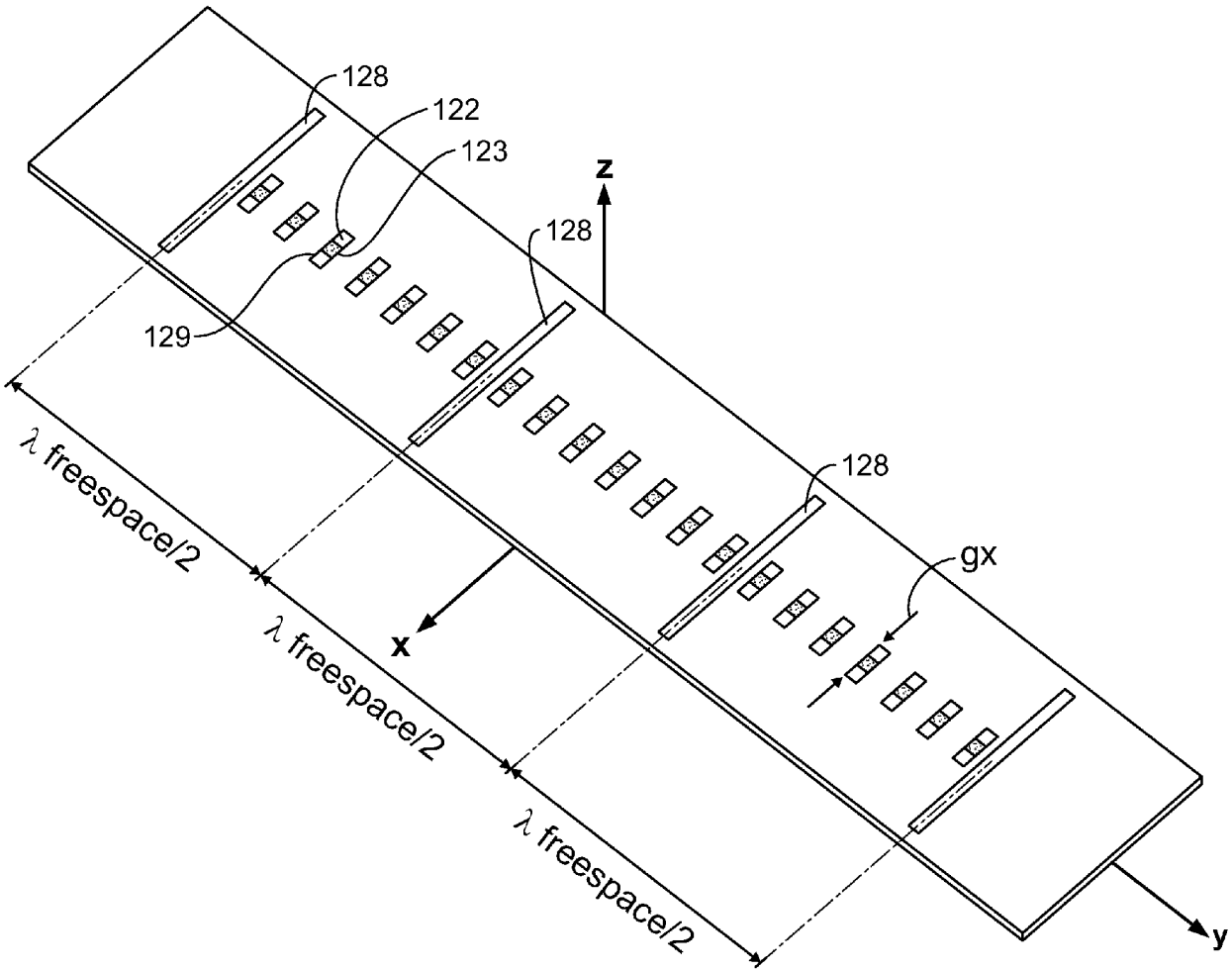
FIG. 12 is a perspective view of phased array having 4 transverse radiators and formed within a SIW.
Figure 13:
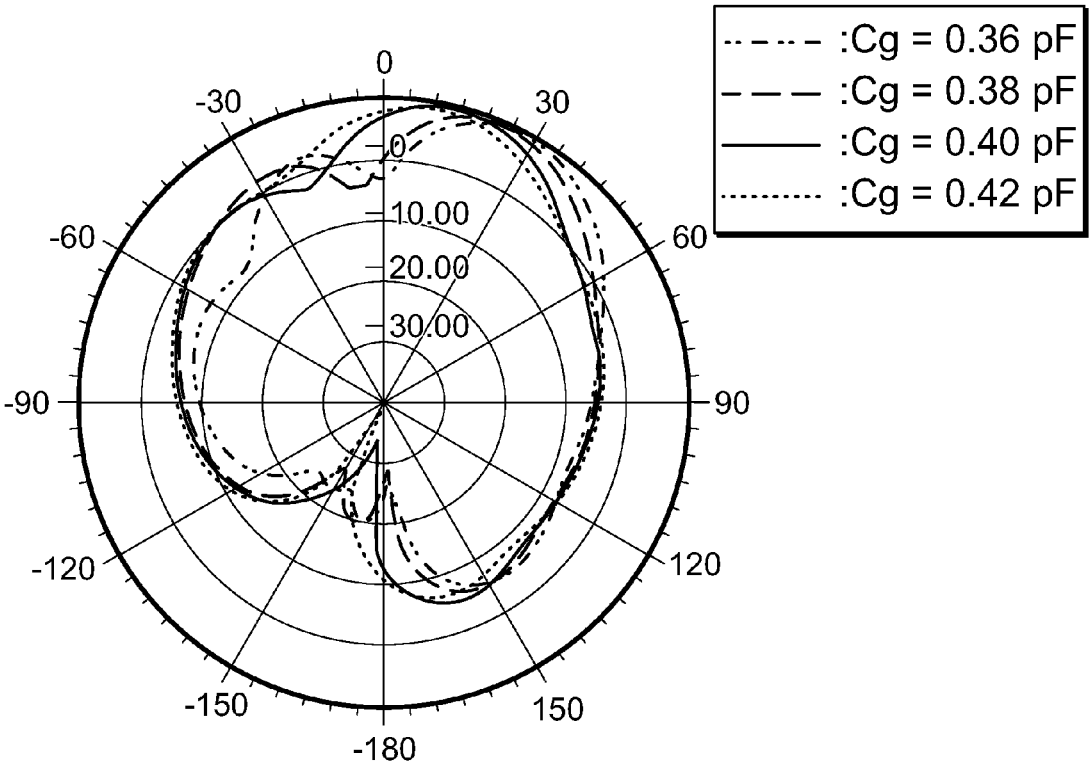
FIG. 13 is a simulation result for the radiation pattern of the device of FIG. 12.
Figure 17A:
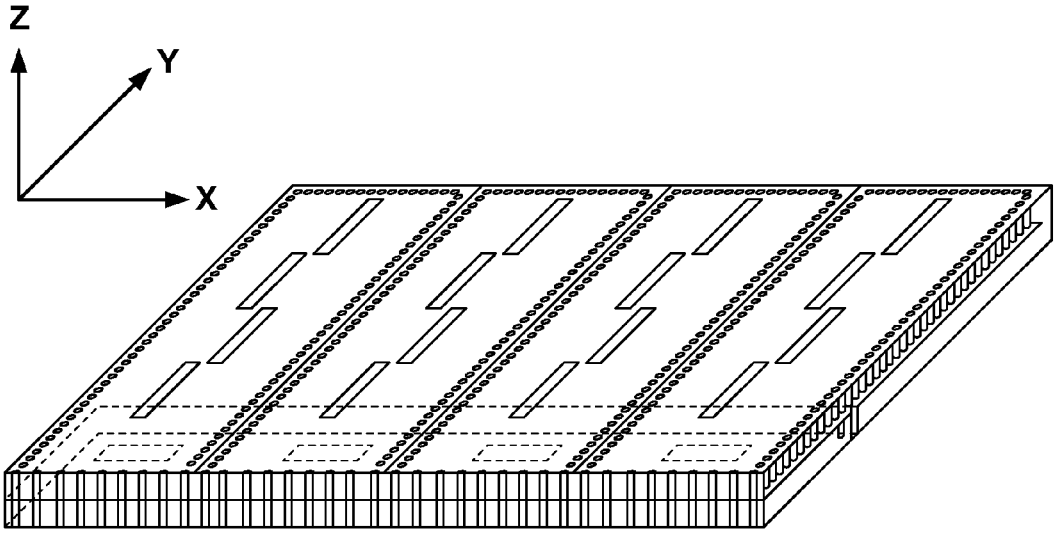
FIG. 17 is a diagram of alternative embodiments for supporting a two dimensional phased array antenna using a SIW as the tunable feed.
Figure 17B:
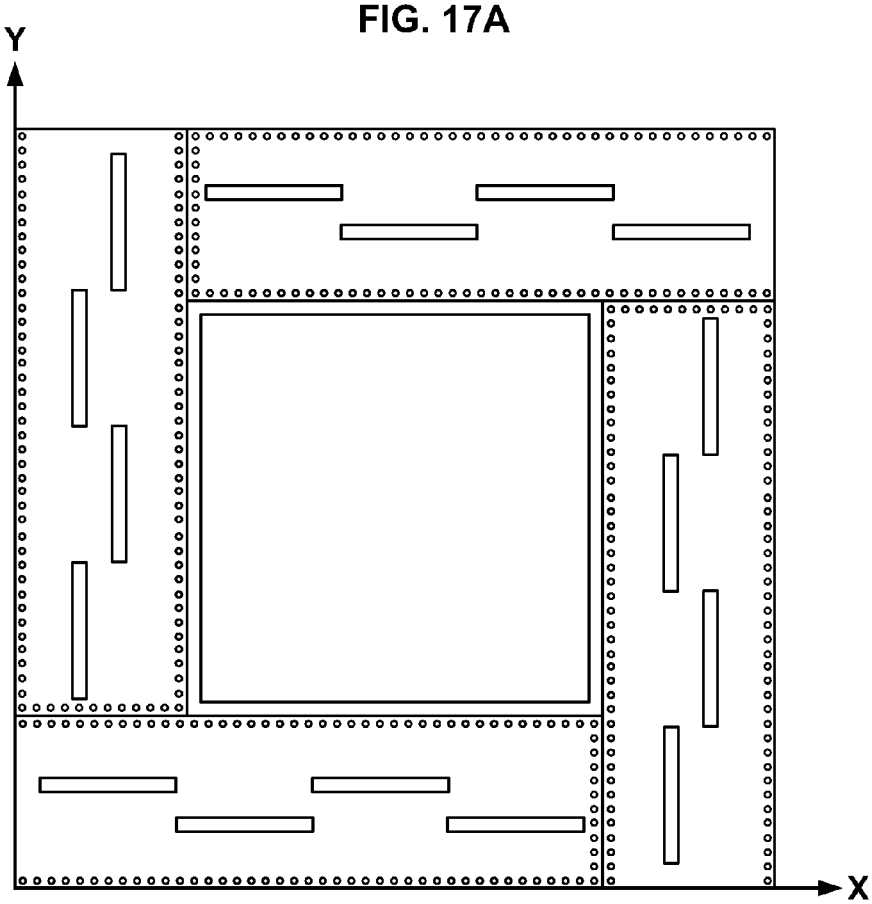

The tunable SIW-based antenna arrays of FIGS. 12 and 14 provide beam steering capabilities only along the longitudinal axis of the array (y-axis). FIG. 17 shows two alternative SIW slot arrays with 2-D beam steering capabilities. Other two-dimensional configurations are also supported and the two presented herein are for exemplary purposes.

Thus, a multidimensional array is supported wherein a known and tunable phase difference is supported between different radiating elements within the array. As is evident from FIG. 17, such an array is implementable in an integrated component providing significant advantages in manufacture, scalability, and reliability. Further, such an integrated device allows for very well controlled manufacturing tolerances.

Though the above embodiments load each slot with a capacitance, it is also supported to load the slots each with a plurality of separate capacitances. For example, two varactors are disposed within a slot on opposing sides of the central longitudinal axis of an array.

Though the above noted embodiments relate to radiators, it is also possible to use the fundamental tunable SIW to provide for other functions. For example, to provide a filter the proposed SIW phase shifter exhibits a significant amount of attenuation in a stopband region thereof (see FIGS. 8 and 9, for example). Since an equivalent circuit to the loaded slot is in the form of parallel LC elements, this type of interconnect typically has a bandreject filter characteristic as confirmed by simulation. To utilize the filter structure as a phase shifter, the desired frequency band operates in the passband region. The stopband can be manipulated by changing the size of the slot, capacitor value and length of the unit cell. A new type of bandreject filter with tuning capabilities is provided by the structure of FIG. 3. An example application for this type of filter is for uplink and downlink filters in satellite communications. Design of filters is based on a large number of parameters such as centre frequency, bandwidth, and quality of roll-off. These were evaluated and the results are presented here.

Figure 18:
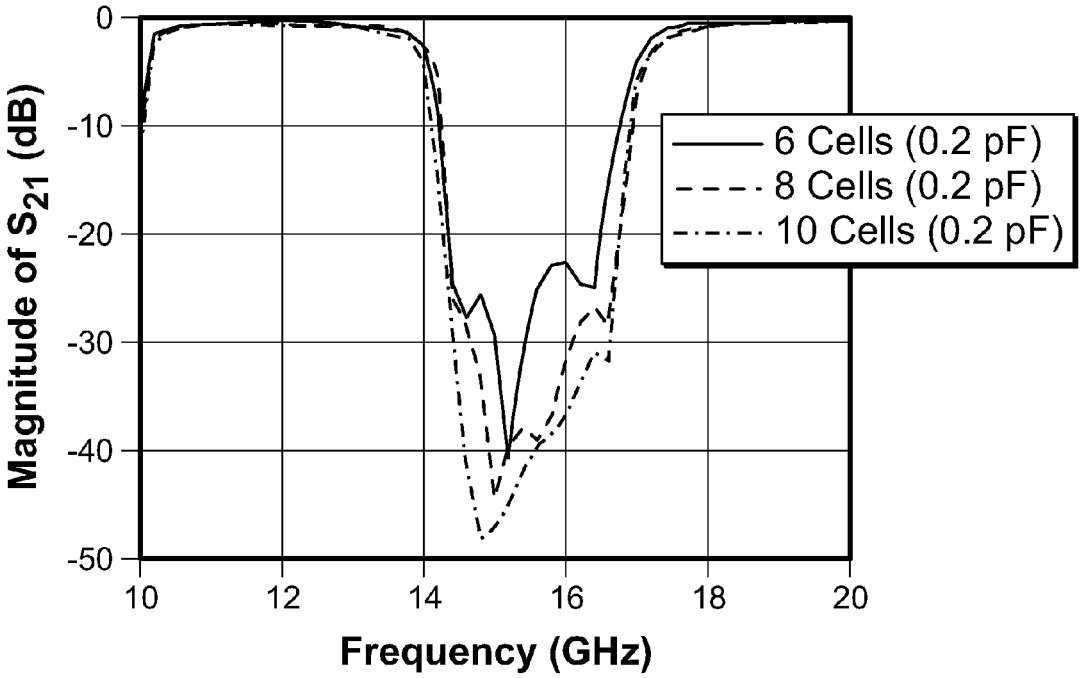
FIG. 18 is a simulation result in graphical form showing a filtering response of a SIW having loaded slots.
Figure 19:
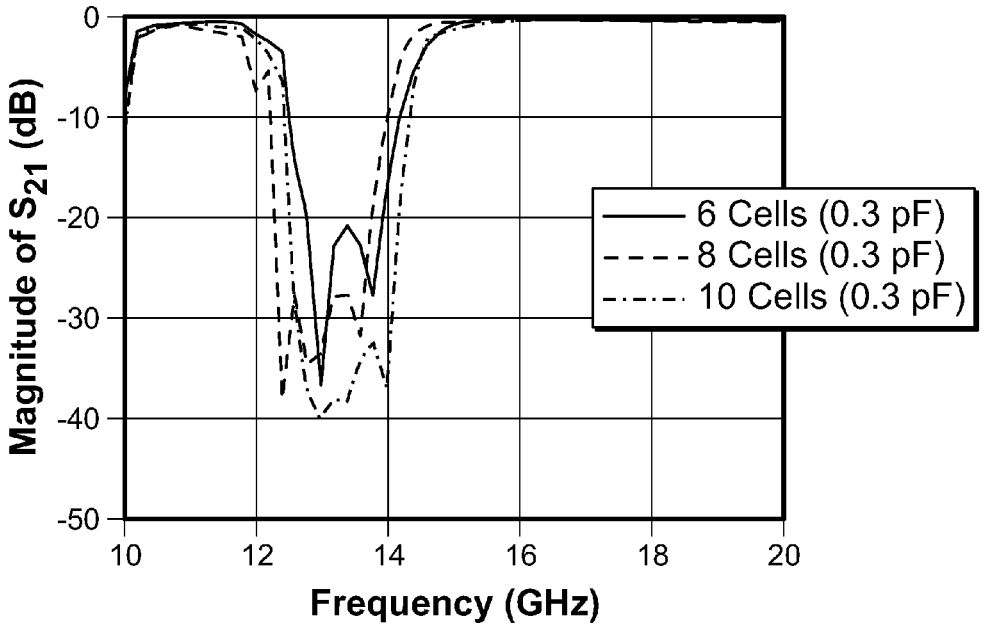
FIG. 19 is a simulation result in graphical form showing a filtering response of a SIW having loaded slots.

FIG. 18 shows the magnitudes of $S_{21}$ for 6, 8 and 10 unit cells for $L_{cell}$=1.5 mm, $g_x$=2 mm and $C_g$=0.2 pF. It is observed that the attenuation in the stopband becomes larger as the number of unit cells increases. The observation is also confirmed in FIG. 19 when $C_g$=0.3 pF. The higher number of unit cells also tend to sharpen the roll-off of the transitions between the passbands and the stopband. Furthermore, a wider slot results in a wider stopband. In general, 30-40 dB of stopband attenuation is achievable with at least 8 unit cells.

Figure 20:
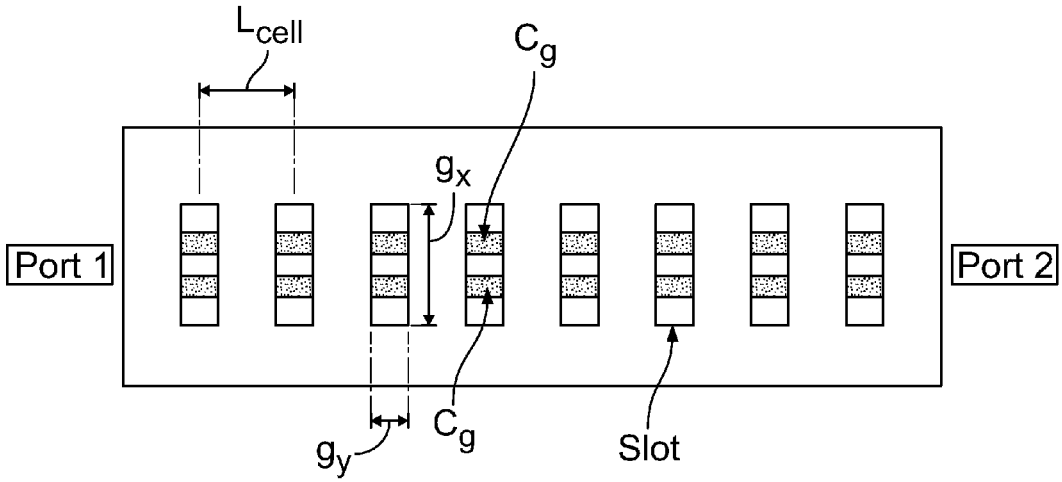
FIG. 20 is a simplified top view of a SIW comprising capacitively loaded slots wherein the slots are each loaded with more than one capacitive element.
Figure 21:
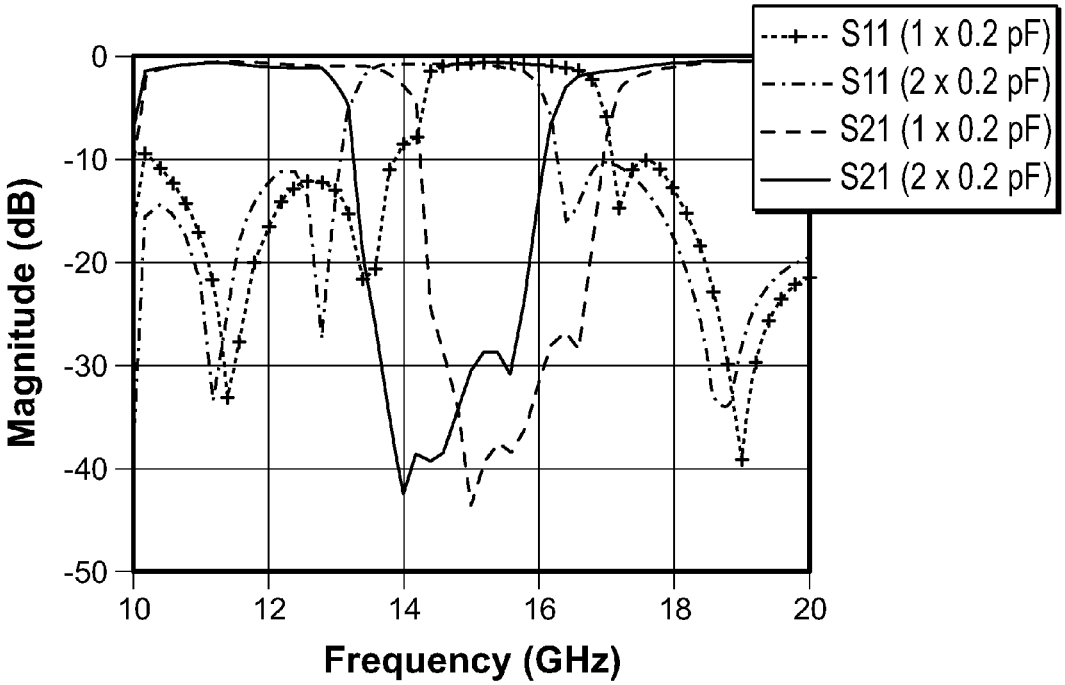
FIG. 21 is a simulation result in graphical form showing a filtering response of a SIW having loaded slots; and, FIG. 22 is a simulation result in graphical form showing a filtering response of a SIW having loaded slots.

Referring to FIGS. 20 and 21, a number of capacitors loading a unit cell is varied. For a typical slot width of 2 mm, 2-3 capacitors can be accommodated as depicted in FIG. 20. Of course, the capacitors are typically tunable, for example varactors. FIG. 21 shows a comparison between single and double capacitor loading per slot for $C_g$=0.2 pF. It can be observed that the stopband region is shifted towards lower frequency for the double-capacitor case. The observation is contrary to the belief that this scenario would be equivalent to that of a single capacitor value of 0.4 pF. As shown the stopband is narrower and very close to the cutoff. Thus, it is possible that the phenomenon can be explained from the point of view that less current will flow around the slot as a large portion will pass through the two capacitors. That said, this is mere speculation. If the speculation is correct, the effective inductance of the slot will be seen lower than that of the single-capacitor case. The reduction in the slot inductance will partially cancel out the increase in the lumped capacitance. Hence, the stopband frequency is shifted slightly.

Figure 22:
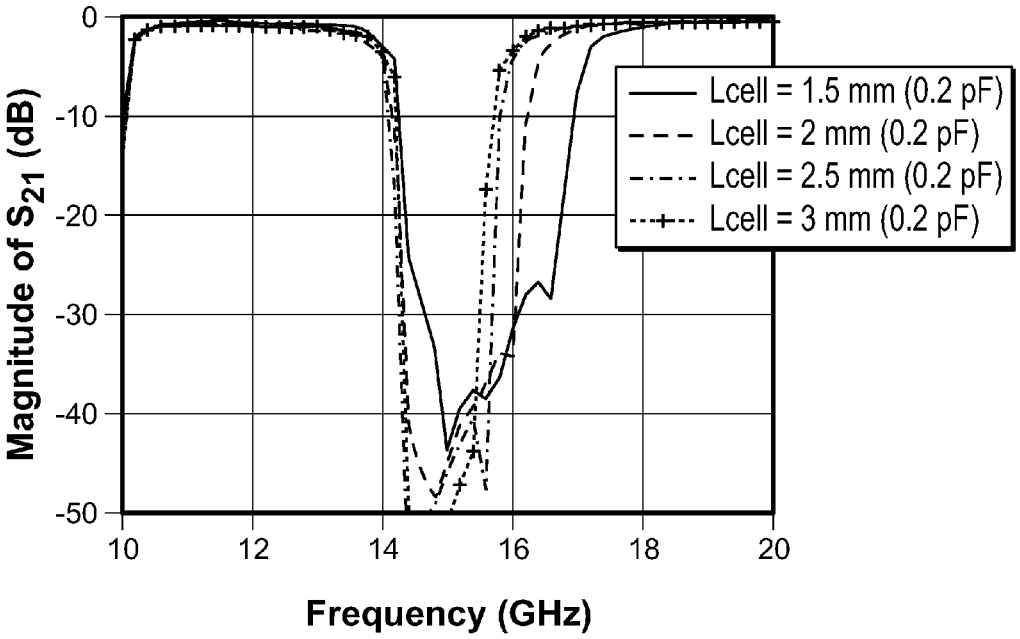

Referring to FIG. 22, the effect of the length of the unit cell ($L_{cell}$=1.5, 2.0, 2.5, 3.0 mm) on the $S_{21}$-parameter is shown. Magnitudes of $S_{21}$ for the case of $L_{cell}$=1.5, 2.0, 2.5, 3.0 mm when $C_g$=0.2 pF are shown. Longer unit cells appear to result in a narrower stopband, sharper roll-off and higher attenuation.

Thus by controlling these parameters, a band reject filter is designable. In all of the above described filter embodiments a capacitively loaded slot is shown, that said, the capacitive loading need not be variable to provide adequate filtering in many applications.

Although various embodiments of the SIW components have been described hereinabove in the context of on board package use, embodiments of the tunable SIWs in accordance with the invention herein described are also applicable in the context of on-chip and on-package (system on chip SOC) use.

Numerous other embodiments may be envisaged without departing from the spirit or scope of the invention.

What is claimed is:

1. An apparatus comprising:

a substrate integrated waveguide (SIW) comprising:

at least one active element for tuning of the waveguide parameters to achieve a tunable SIW; and a plurality of transverse slots spaced one from another along a longitudinal direction of the SIW, within at least one of the plurality of transverse slots at least one of the at least one active element is disposed, wherein the at least one active element is an active electronic component for loading of the at least one of the plurality of transverse slots within which the at least one active element is disposed and the at least one active element is a varactor for capacitively loading one of the plurality of transverse slots.

2. An apparatus comprising:

a substrate integrated waveguide (SIW) comprising:

at least one active element for tuning of the waveguide parameters to achieve a tunable SIW; and a plurality of transverse slots spaced one from another along a longitudinal direction of the SIW, within at least one of the plurality of transverse slots at least one of the at least one active element is disposed, wherein the at least one active element is an active electronic component for loading of the at least one of the plurality of transverse slots within which the at least one active element is disposed.

3. An apparatus according to claim 2, wherein the at least one active element is at least one of a plurality of varactors for capacitively loading the at least one of the plurality of transverse slots.

4. An apparatus comprising:

a substrate integrated waveguide (SIW) comprising:

at least one active element for tuning of the waveguide parameters to achieve a tunable SIW; and a plurality of transverse slots spaced one from another along a longitudinal direction of the SIW, wherein at least one of the plurality of transverse slots is loaded with the at least one active element for varying a phase of a signal propagating within the SIW.

5. An apparatus according to claim 4, wherein the SIW forms a filter for rejecting portions of the signal propagating within the SIW that are within a known range of frequencies.

6. An apparatus according to claim 4, wherein the SIW forms a feed path for radiators of a phased array of radiators, the feed path imparting phase shift for beam steering of a radiated signal from the phased array of radiators.

7. An apparatus according to claim 6, wherein the phased array of radiators comprise slot radiators disposed parallel to a longitudinal direction of the phased array of radiators.

8. An apparatus according to claim 6, wherein the phased array of radiators comprise slot radiators disposed transverse to a longitudinal direction of the phased array of radiators.

9. An apparatus according to any one of claims 2 through 4 and 6 through 8, wherein the SIW comprises a plurality of slots disposed transverse to a direction of propagation of radiation within the waveguide, at least some of the plurality of slots loaded with a tunable load, the tunable load for effecting a phase shift on signals propagating within the waveguide wherein a plurality of loaded slots provide a cumulative phase shift for signals being provided from the waveguide.

10. An apparatus comprising:

a substrate integrated waveguide (SIW) comprising:

a waveguide structure comprising a plurality of transverse slots each spaced one from another by a known distance; and, a plurality of loads for capacitively loading each of the plurality of transverse slots, the plurality of loads providing variable capacitance for altering parameters of the SIW in response to changing of capacitive loading.

11. An apparatus according to claim 10 comprising: a plurality of radiators disposed longitudinally along the SIW and next to at least some of the plurality of transverse slots, each of the plurality of radiators for radiating a signal from the waveguide, the signal phase shifted in accordance with the plurality of transverse slots adjacent thereto such that a same signal with a different phase is radiating from each of the plurality of radiators for forming a phased array.

12. An apparatus according to claim 10, comprising: a plurality of radiators disposed longitudinally along the SIW and between at least some of the plurality of transverse slots, each of the plurality of radiators for radiating a signal from the waveguide, the signal phase shifted in accordance with the plurality of transverse slots preceding thereto such that a same signal with a different phase is radiating from each of the plurality of radiators for forming a phased array.

* * * * *